United States Patent [19]

Ketterer et al.

[11] 3,957,004

[45] May 18, 1976

[54] HAND-OPERATED LOCK STITCH SEWING MACHINE

[75] Inventors: Stanley Joseph Ketterer, Middlesex, N.J.; Francis Ivanko, Columbia, Pa.

[73] Assignee: The Singer Company, New York, N.Y.

[22] Filed: Apr. 25, 1975

[21] Appl. No.: 571,679

[52] U.S. Cl. ..... 112/169; 112/185; 112/187; 112/195

[51] Int. Cl.[2] ..... D05B 1/00

[58] Field of Search ..... 112/80, 169, 199, 234, 112/187, 194, 195, 196, 185, 402

[56] References Cited

UNITED STATES PATENTS

| | | | |
|---|---|---|---|
| 400,744 | 4/1889 | Brüncker | 112/195 |
| 1,186,518 | 6/1916 | Reece | 112/402 |
| 2,507,814 | 5/1950 | Rantanen | 112/169 |
| 3,127,859 | 4/1964 | Saltz et al. | 112/169 |

*Primary Examiner*—Werner H. Schroeder
*Assistant Examiner*—Moshe I. Cohen
*Attorney, Agent, or Firm*—Marshall J. Breen; Edward L. Bell; Linval B. Castle

[57] ABSTRACT

A hand-held single-thread lockstitch sewing machine or stitcher for attaching buttons, snaps, bar tacks, or the like, employs a boat-type shuttle for capturing the loop thrown by the needle. A limited length of bottom thread is stored by manually positioning a lever which directs the loop over a finger-like projection in the shuttle to trap the loop. Repositioning the lever will allow the machine to sew normally with the loop passing around the shuttle and picking up the stored thread. Bottom tension is applied by magnetically attracting the shuttle to the carrier wall and passing the bottom thread between the shuttle and the carrier wall.

6 Claims, 9 Drawing Figures

HAND-OPERATED LOCK STITCH SEWING MACHINE

This invention relates to hand-held stitchers and particularly to an improved stitcher requiring only a single thread source to produce a true lockstitch in which the resulting stitch is formed by separate thread limbs, one on the top and the other beneath the material with only a single strand of each thread limb extending between successive needle penetrations and with both thread limbs being looped together preferably at a point equidistant from the top and bottom surfaces of the material being stitched. Upon the first needle penetration in a stitching operation, a limited length of bottom thread is drawn from the single thread source and is stored by manually positioning a lever which guides the needle loop over a thread-holding finger centrally positioned within an opening in the boat-type shuttle. Upon completion of the first stitch, the lever is automatically repositioned to permit the stitcher to sew normally with the loop passing around the shuttle and picking up the stored thread. The boat-type shuttle is loosely confined within a cage formed by the walls of the shuttle carrier but is magnetically attracted to one wall so that, when the loop thrown by the needles is entered by the shuttle, the magnetic attraction between the shuttle and the carrier wall provides the necessary tension to the bottom thread.

In the drawings which illustrate a preferred embodiment of the invention:

Figure 1:
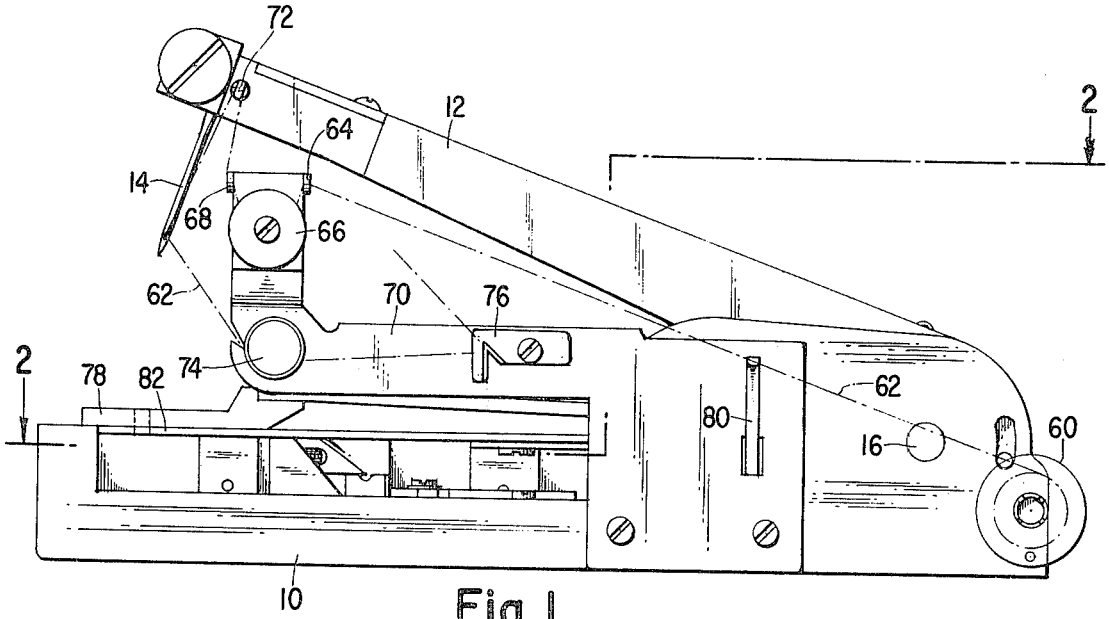
FIG. 1 represents an elevational view of one side of the hand stitcher embodying this invention.
Figure 2:
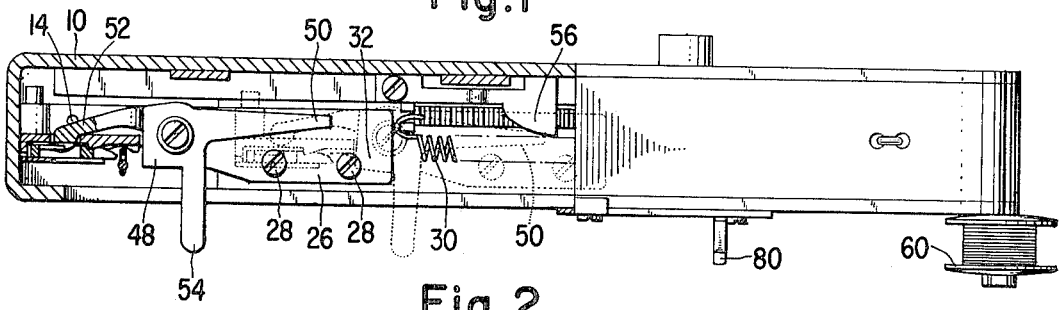
FIG. 2 represents a plan view, partly in section, of the hand stitcher taken along the lines 2—2 of FIG. 1 with however, the needle carrier depressed and the shuttle carrier shown in the forward position ready to receive and store bottom thread.
Figure 3:
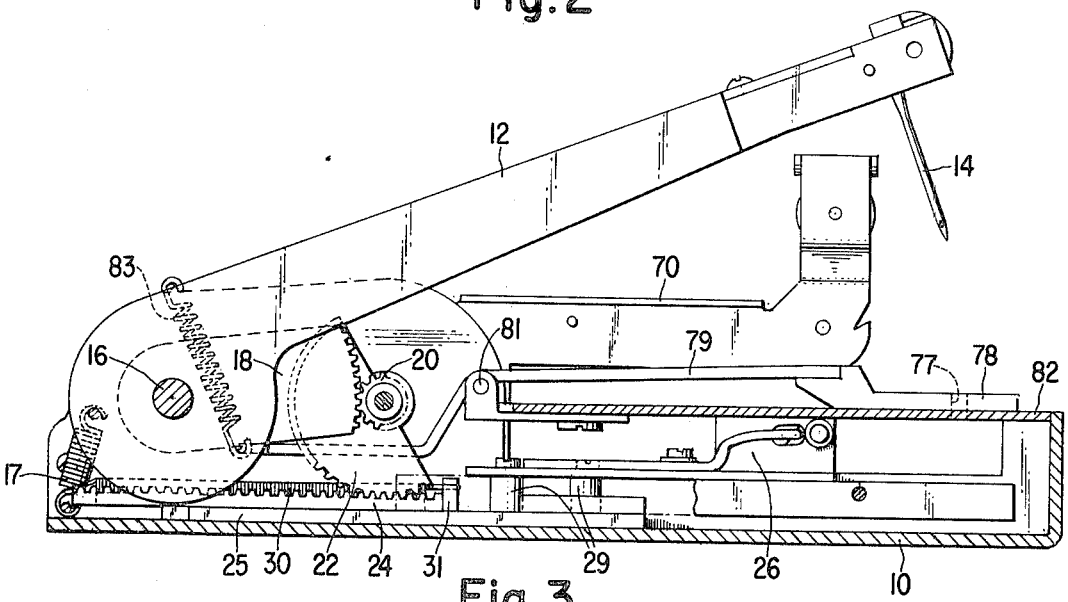
FIG. 3 represents the elevational view, partly in section, of the second side of the hand stitcher.

Turning now to a detailed description of the drawings, FIGS. 1, 2, and 3 are illustrations representing plan and elevational views of the hand stitcher embodying the invention. The stitcher is fabricated upon a channel-like main frame 10, that preferably has a length of approximately 7 inches. A needle carrier 12, which at one end supports a needle 14, is rotatably carried at its other end on a pivot post 16 affixed to main frame 10, so that the carrier 12 may be rotated from a position overlying and substantially parallel to the main frame 10 to an angle of approximately 20° from the longitudinal axis of the frame 10. Tension spring 17 attached to the main frame 10 and needle carrier 12 as shown in FIG. 3 maintains the needle carrier 12 normally at an angle to the main frame unless depressed for purposes to be described below.

As shown in FIG. 3, a gear section 18, connected to needle carrier 12 and coaxial with pivot 16, engages a spur gear 20 that is coaxially connected to a larger diameter pinion 22 which engages a rack 24 affixed to a slide 25 arranged to move horizontally along the lower floor of the main frame 10. The above gearing has been selected so that depression of the needle carrier 12 throughout its approximately 20° arc, will produce about 1½ inches of travel of the rack 24 which is coupled to impart longitudinal motion to a shuttle carrier 26 connected by screws 28 to extension posts 29 affixed to the slide 25. An extension spring 30 (see FIG. 2) extending from post 31 on slide 25 to the end of main frame 10 (see FIGS. 2 and 3) draws the shuttle carrier 26 to a retracted position and aids tension spring 17 in maintaining needle carrier 12 in an elevated position.

Figure 4:
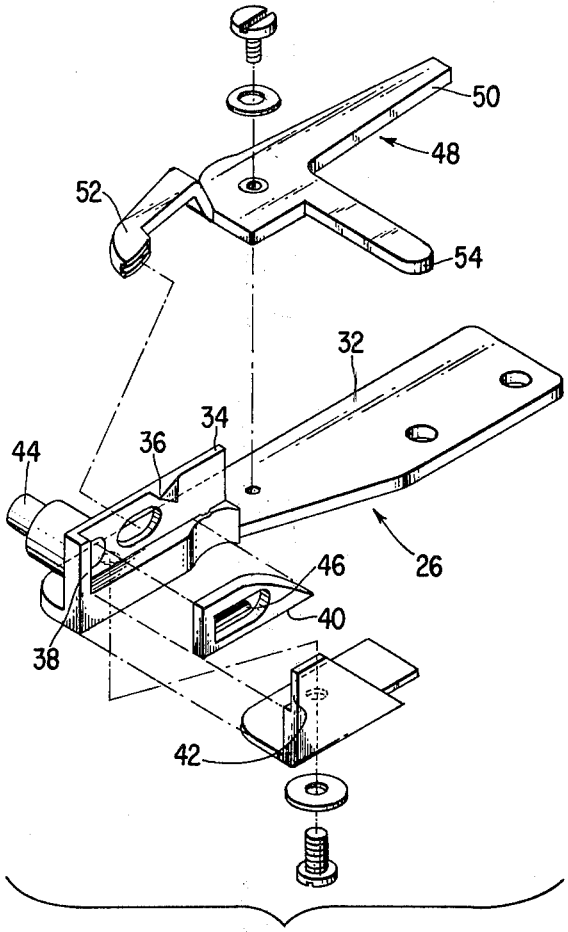
FIG. 4 is a perspective drawing illustrating the details of the shuttle carrier.

Shuttle carrier 26, which is illustrated in detail in FIG. 4, is comprised of a flat bed plate 32 and a vertical wall 34 having a triangular shaped protrusion 36 and an end wall 38. Shuttle 40 is adapted to loosely fit against the carrier wall 34 between the protrusion 36 and the end wall 38 and is retained therein by an opposite wall 42 suitably attached to the shuttle carrier 26, thus forming the cage within which shuttle 40 is loosely enclosed. The shutle 40 is, however, closely held against the carrier wall 34 by a magnet 44 which is attached to and extends through the shutter carrier wall 34. Accordingly as the shuttle 40 enters the loop thrown by the needle, the movement of the thread passing between the shuttle 40 and the carrier wall 34 is restricted by the magnetic attraction between the magnet 44 and the shuttle, thereby providing the necessary tension to the bottom thread.

As shown in FIGS. 4 through 9, the boat-type shuttle 40 contains a central opening into which extends a holding finger 46, the purpose of which is to trap a leg of the needle loop during the first penetration of the needle, as will be subsequently explained.

Figure 5:
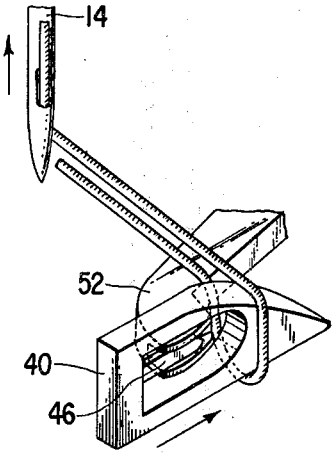
FIG. 5 is a perspective view illustrating the boat-type shuttle and the mechanism for trapping the loop thrown by the needle.

Pivotally attached to the top of bed plate 32 of shuttle carrier 26 is a bottom thread trapping lever 48, a generally T-shaped fixture having a tapered arm 50 and a cammed arm 52 which lie generally along the longitudinal axis of the shuttle carrier 26, and an actuating arm 54 extending substantially at right angles to the longitudinal axis of the carrier and outside of the wall of the main frame 10. The cammed arm 52 of the trapping lever 48 contains a tip having a generally U-shaped cross-section that is adapted to loosely straddle the holding finger 46 in the central aperture of the shuttle 40, as best illustrated in FIG. 5. As shown in FIG. 5, the U-shaped tip of the arm 52 is slightly curved so that, when positioned astraddle of holding finger 46, it will guide the thread loop around the holding finger, as will be subsequently described in connection with the description of FIGS. 6–9.

The plan view of FIG. 2, shows that the bottom thread trapping lever 48 is pivotally affixed to the top of bed plate 32 with actuating arm 54 extending beyond the side of main frame 10 and the cammed arm 52 straddling the holding finger 46 in the shuttle 40. As the needle carrier 12 is released and the shuttle carrier 26 retracts away from the needle position, the arm 50 engages the curved camming surface of bottom thread trapping lever repositioning cam 56 that is attached to the wall of the main frame 10. The bottom thread trapping lever 48 is thus slightly pivoted so that its cammed arm 52 no longer straddles the holding finger 46 in the shuttle, as shown in the phantom sectional view of FIG. 2.

As previously mentioned, the hand stitcher uses a single thread source, preferably from a thread supply spool 60 supported by a suitable spindle extending from the side wall of the frame 10 as best shown in FIGS. 1 and 2. The thread 62 is passed from the spool 60 to a fixed thread guide 64, a thread tension member 66, and a second fixed thread guide 68 that are attached to a support plate 70 mounted upon the side wall of the main frame 10. Thread 62 is then passed to thread guide 72 on the needle arm 12 and thence through the thread eye in the eye-pointed needle 14. After passing through the eye of needle 14, thread 62 is passed around a spring-loaded thread clip 74, mounted on support plate 70, to a thread cutter 76. The cutting edge of cutter 76 is approximately 1½ inches from the thread clip 74 and provides a fixed limited length of thread which, upon a first operation of the stitcher, will release from clip 74 to engage the holding finger 46 in the shuttle 40, thereby supplying the necessary bottom thread supply for the production of lock-stitches.

Referring to FIG. 3, a presser foot 78, having an orifice 77 for passage of the needle 14 and thread 62, is affixed to the end of a presser foot lever 79 pivoted at 81. An extension spring 83 attached to the presser foot lever 79 and to the needle carrier 12 serves to urge the presser foot 78 against the throat plate 82. A presser foot release lever 80 (See FIGS. 1 and 2) may be depressed to have a portion thereof (not shown) impinge against the presser foot lever 79 adjacent to extension spring 83 to rotate the presser foot lever 79 about pivot 81 and elevate the presser foot 78.

With the thread 62 loaded in the stitcher as indicated above, the stitcher is now ready for operation. The presser foot 78 may be raised by depressing the presser foot release lever 80 and the material to be stitched inserted between the presser foot 78 and the throat plate 82. The arm of needle carrier 12 is then slightly depressed so that the bottom thread trapping lever 48 is released from its repositioning cam 56 as shown in FIG. 2. The actuating arm 54 of the trapping lever 48 is then moved so that the cammed arm 52 straddles the holding finger 46 in the shuttle 40. The needle carrier is then fully actuated so that the needle penetrates through material being stitched while, simultaneously, releasing the thread 62 from the thread clip 74. With the needle carrier 12 fully depressed, the shuttle carrier 26 is in its most forward position so that the apex of the boat-type shuttle 40 is positioned to enter the thread loop that will form when the needle carrier 12 is released and the needle 14 begins to move upward as is clearly shown in FIG. 2. FIG. 5 is an illustration of the position of the shuttle 40 as the needle 14 moves upward and the shuttle 40 begins to enter the loop. The cammed arm 52 of the bottom thread trapping lever 48 is shown straddling the holding finger 46 so that the thread loop will pass over the holding finger 46 rather than to pass completely around the shuttle 40.

Figure 6:
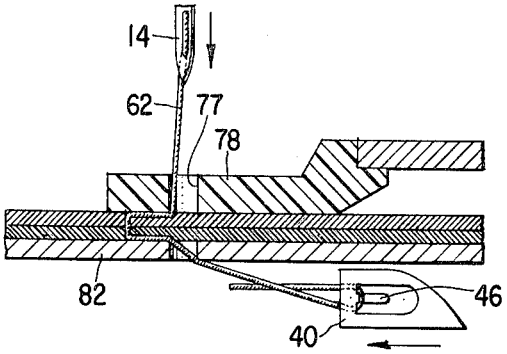
FIGS. 6–9 are sectional views illustrating various steps in the formation of the locksmith produced by the hand stitcher.
Figure 7:
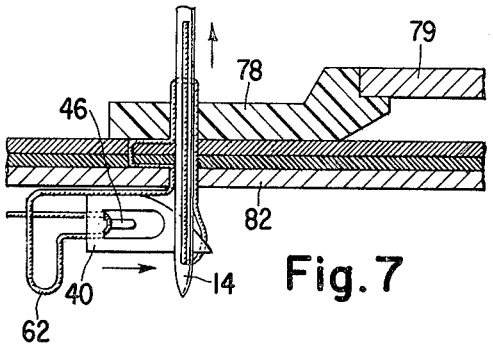
Figure 8:
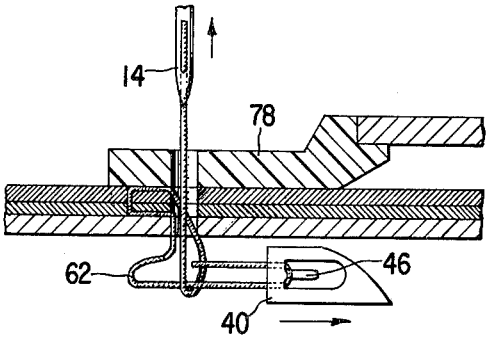
Figure 9:
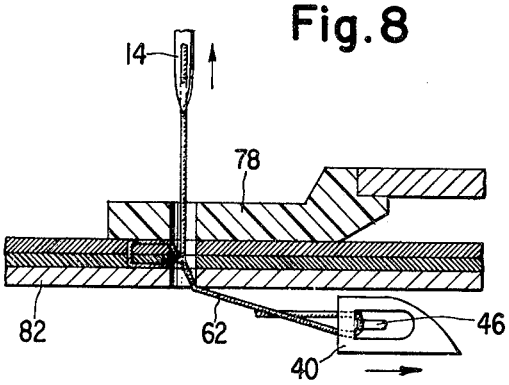

FIG. 6 illustrates the relative positions of the shuttle and needle after completion of the first depressing of the needle carrier 12. It will be noted that the thread 62 is trapped by the holding finger 46, the material to be stitched has been moved, and the needle 14 is being lowered in preparation for the second stitch. When the needle carrier 12 has been fully depressed and then permitted to raise slightly, the beak of the shuttle 40 again stands ready to enter the loop thrown by the needle as shown in FIG. 7. As the needle 14 completes its upward motion, the shuttle 40 enters the thread loop to start the formation of the first lock stitch. It will be noted that since the shuttle carrier 26 has been returned to the position where the tapered arm 50 of thread trapping member 48 had engaged the repositioning cam 56, as shown in FIG. 2, the U-shaped camming arm 52 of the trapping lever no longer straddles the holding finger 46 of the shuttle 40, so that the needle loop formed by the upward motion of the needle 14 is free to pass completely around the caged shuttle 40. It will be remembered also that the magnetic attraction between the shuttle 40 and the magnet 44 in the carrier wall 34 now provides the necessary bottom thread tension. Accordingly, as needle 14 rises further and shuttle 40 continues to retract, the thread 62, upper tension being applied by the upper thread tension member 66 and the bottom tension applied by the magnetic attraction between the shuttle and the carrier wall magnet, produces a true lockstitch in the material as illustrated in FIG. 9.

It will be appreciated that the length of the stitch produced by the stitcher is limited to the length of the bottom thread transferred upon the first depression of the needle carrier 12. It will be further appreciated that since the under thread and the top thread are one and the same, the first stitch is a closed loop and is not comprised of two separate interlocked threads as inherent in lockstitch sewing machines. As previously mentioned, the lockstitcher embodying the invention is not intended to function as a sewing machine but is intended primarily to sew buttons, snaps, sewing bar tacks, and other miscellaneous short stitching operations.

Having thus set forth the nature of the invention, what is claimed herein is:

1. In a hand stitcher having a frame;

a throat plate adjacent a first end of said frame;

a needle carrier pivotally connected at one end to the second end of said main frame and supporting a thread carrying eye pointed needle at the opposite end;

a thread cutter positioned at a predetermined distance from said eye pointed needle;

a shuttle carrier slideably mounted within said frame and geared to move toward and away from said throat plate upon respectively depressing and raising said needle carrier;

and a boat-type shuttle loosely confined within a cage connected to the shuttle carrier, the improvement comprising:

holding means connected to said shuttle for trapping the leg of the thread loop thrown by the needle upon the first depression of the needle through said throat plate whereby thread, having a length determined by the distance of said thread cutter from said needle eye, is drawn beneath said throat plate to provide the bottom thread for producing lockstitches.

2. The stitcher claimed in claim 1 further including bottom thread tensioning means comprising a magnet positioned in the wall of the shuttle cage for magnetically attracting said boat-type shuttle to said wall.

3. The stitcher claimed in claim 1 in which said holding means comprises a holding finger positioned within an aperture extending laterally through said shuttle.

4. The stitcher claimed in claim 3 further including a bottom thread trapping lever pivotally mounted to said shuttle carrier and having a cammed member with a U-shaped cross-section for straddling said holding finger whereby the thread loop thrown by the needle will be guided around and retained by said holding finger.

5. The stitcher claimed in claim 4 further including a repositioning cam mounted to said main frame and positioned to engage an arm of said bottom thread trapping lever to remove said cammed member from its straddling position of said holding finger.

6. The stitcher claimed in claim 5 further including bottom thread tensioning means comprising a magnet positioned in the wall of the shuttle cage for magnetically attracting said boat-type shuttle to said wall.

* * * * *